US005601413A

United States Patent [19]

Langley et al.

[11] Patent Number: 5,601,413

[45] Date of Patent: Feb. 11, 1997

[54] AUTOMATIC LOW FLUID SHUT-OFF METHOD FOR A PUMPING SYSTEM

[75] Inventors: Gregory A. Langley, Derby; David L. Hansen, Wichita, both of Kans.

[73] Assignee: Great Plains Industries, Inc., Wichita, Kans.

[21] Appl. No.: 606,268

[22] Filed: Feb. 23, 1996

[51] Int. Cl.[6] ..... F04B 49/00

[52] U.S. Cl. ..... 417/12; 417/42; 417/43; 417/44.11; 417/53; 73/861.77; 222/63; 222/66

[58] Field of Search ..... 417/12, 18, 20, 417/22, 36, 43, 44.2, 45, 53, 42, 44.11; 364/510, 479; 73/861.77, 861.78, 168, 223; 222/14, 63, 66

[56] References Cited

U.S. PATENT DOCUMENTS

| | | | |
|---|---|---|---|
| 3,559,731 | 2/1971 | Stafford | 166/53 |
| 3,930,752 | 1/1976 | Douglas | 417/12 |
| 3,936,231 | 2/1976 | Douglas | 417/12 |
| 4,119,865 | 10/1978 | Elderton | 307/118 |
| 4,209,258 | 6/1980 | Oakes | 366/138 |
| 4,329,120 | 5/1982 | Walters | 417/12 |
| 4,357,131 | 11/1982 | Guillemot | 417/12 |
| 4,781,536 | 11/1988 | Hicks | 412/12 |
| 4,795,314 | 1/1989 | Prybella et al. | 417/43 |
| 4,798,092 | 1/1989 | Lagergren et al. | 73/861.77 |
| 4,874,294 | 10/1989 | Karg | 417/12 |
| 4,913,625 | 4/1990 | Gerlowski | 417/18 |
| 5,006,044 | 4/1991 | Walker, Sr. et al. | 417/12 |
| 5,020,972 | 6/1991 | Nakayama et al. | 417/37 |
| 5,180,287 | 1/1993 | Natwick et al. | 417/43 |
| 5,190,442 | 3/1993 | Jorritsma | 417/7 |

OTHER PUBLICATIONS

Advertising brochure entitled "Flow Control System I" published by Wilden Pump & Engineering Co., Colton, CA, 1994.

Special Products Bulletin entitled "Conclude Soybean Herbicide" published by BASF Date:unk.

Product Bulletin entitled "DryLock Closed Dispensing System" published by Aeroquip Corporation, Maumee, OH 1994.

*Primary Examiner*—Timothy Thorpe
*Assistant Examiner*—Xuan M. Thai
*Attorney, Agent, or Firm*—Herzog, Crebs & McGhee, LLP

[57] ABSTRACT

A method and apparatus for automatically shutting off a dispensing device when the fluid source tank is empty includes a programmed pump controller in communication with the dispensing device and a flowmeter having a pulse generator. Upon startup of the dispensing device, the controller waits for an initial time period, then periodically determines the pulse frequency which correlates to a rate of fluid flow. The pulse frequency is compared to a calculated average pulse frequency and, if the pulse frequency has changed a pre-selected, pre-determined amount or percentage when compared to the average pulse frequency the dispensing device is shut-off. The change in pulse frequency indicates ingestion of air into the pumping system meaning an empty source tank.

20 Claims, 3 Drawing Sheets

AUTOMATIC LOW FLUID SHUT-OFF METHOD FOR A PUMPING SYSTEM

BACKGROUND OF THE INVENTION

1. Field of the Invention

The present invention relates generally to electronic pump control systems and, more particularly, to electronic pump control systems to disable or shut down the pump upon a low fluid condition.

2. Description of the Prior Art

Pumping systems for transferring liquid out of a container are well known in the art. Most pumping systems do not require that the amount of liquid being pumped be measured for example, in sumps, sewer treatment facilities, and general drainage. However, in pump systems for the dispensing of agricultural chemicals and the like that are to be mixed with water or other diluent, it is important to accurately measure the amount of chemical being dispensed. This is because the concentration of chemicals and dilution rates can affect the product application and/or effectiveness.

In response to the above, pump controllers have been devised to work in conjunction with the pump to meter out required amounts in response to inputted or selected amounts or volume of liquid. Once the desired volume of liquid has been pumped as determined by the controller, the controller shuts off the pump. At this point, the diluent may be added to the chemical. In cases where the chemical is not diluted, precise volume amounts generally also need to be known. In some systems, a device, such as a flowmeter, is used to provide flow data for determining the volume of liquid pumped. The device is in communication with the pump controller. A drawback to these systems, however, is that they provide false readings regarding volume pumped when the source tank of liquid becomes empty as the flow of air will be registered by the flowmeter as liquid flow.

In the prior art, some pumping systems have utilized pressure devices in the flow lines to determine pressure differentials in order to control the pump. Other systems have sensed pump rotation to determine fluid flow rate. Still, other systems utilize liquid level sensors in the source tank to monitor fluid level.

All of these systems require additional sensors, and in the case of liquid level sensors, the source tank must have the sensors therein. To date there is no simple and efficient system for indicating when the fluid source tank becomes empty without having a myriad of sensors. If the fluid source tank becomes empty and the system continues believe that something is being pumped, inaccurate measurement of the fluid will result. One cannot be by the pumping system at all times in order to monitor fluid flow. Also, the use of additional indicia equipment is cumbersome and objectionable.

Therefore, it is an object of the present invention to provide a simple method whereby the pump is shut off when the fluid source becomes empty.

It is another object of the present invention to provide a method whereby the pump controller in conjunction with the flowmeter can determine whether or not the fluid source tank is empty without the use of tank liquid level indicia equipment.

It is also an object of the present invention to provide an apparatus for the same.

SUMMARY OF THE INVENTION

The present invention is a method and apparatus for automatically stopping a pump, dispensing device, or dispensing control device when the fluid containing source tank is empty. The method has been programmed into a pump controller which is in communication with the pump, or other flow control device and a pulse generating flowmeter, fluidly coupled to and downstream of the pump.

The pump controller generally is a batching system that allows an operator to enter a desired volume of liquid to be dispensed. The pump controller then starts the pump, receives signals from the flowmeter, and counts down as the fluid flows through the flowmeter as indicated by the flowmeter. When the count reaches zero, the pump controller disconnects power to the pump thereby stopping the same.

With the present invention, the signals generated by the flowmeter correlating to the flow rate of liquid therethrough is continuously monitored. When the pump controller determines a change in flow rate by more than a predetermined amount or percentage, the pump controller shuts off the pump. The change in flow rate is caused by the ingestion of air by the pumping system. The air comes into the flow line from the source tank when the source tank becomes empty.

In accordance with an aspect of the present invention, at pump start-up, the pump controller automatic low fluid shut-off (ALFS) program is inhibited for a short period of time to allow for a steady flow of liquid to develop. The pulse rate or pulse frequency from the flowmeter is determined once every predetermined interval. This "instantaneous" pulse frequency is compared to an average pulse frequency calculated over a predetermined time period, that may be a predetermined number of predetermined intervals. If the pulse frequency has changed over the average pulse frequency by more than a predetermined amount, the pump is shut-off.

The ALFS is a feature of the pump controller that may be enabled or disabled, by the manufacturer. If enabled, it may be disabled by the operator. Also, the amount or percentage change of the pulse frequency over the average pulse frequency is selectable by the manufacturer.

The apparatus is a programmed pump controller that is in communication with a flowmeter and the pump. The pump controller includes a microcontroller, keypad, and display all in communication with each other.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiment thereof which is illustrated in the appended drawings.

It is noted, however, that the appended drawings illustrate only a typical embodiment of this invention and is therefore not to be considered limiting of its scope, for the invention may admit to other equally effective embodiments. Reference the appended drawings, wherein.

DESCRIPTION OF PREFERRED EMBODIMENT

Figure 1:
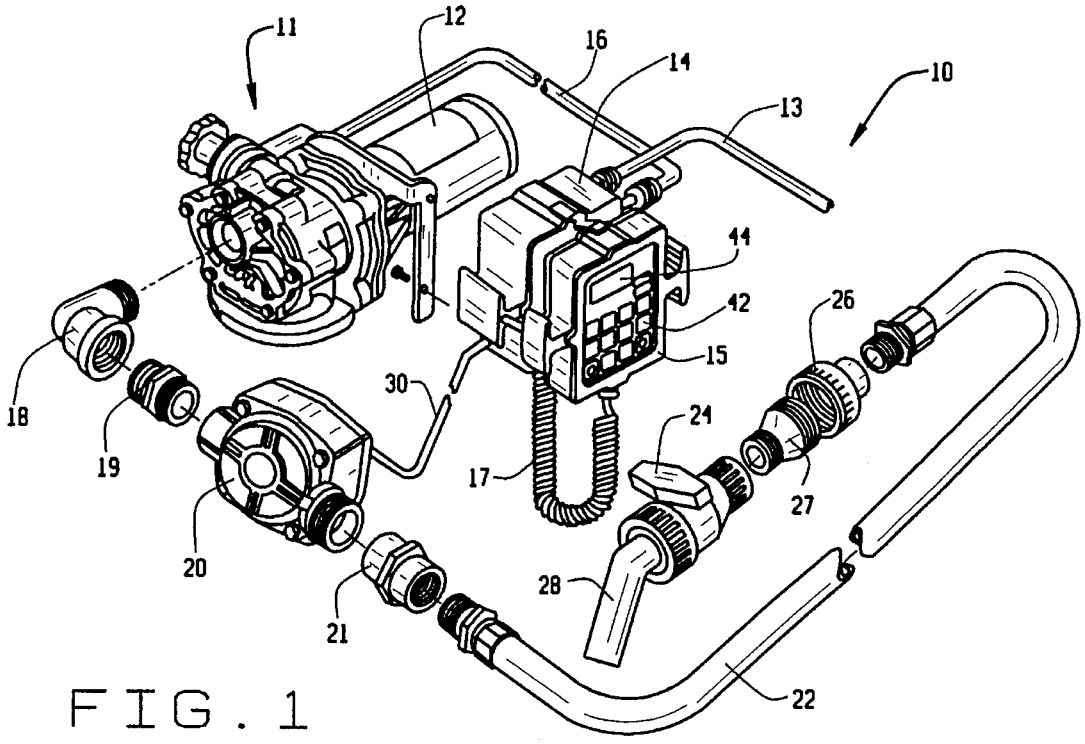
FIG. 1 is a perspective, partially exploded view of a typical pumping system.

Referring to FIG. 1, there is shown the components and hookup of a typical pumping system generally designated 10 as might be used in a typical agricultural chemical dispensing system. The pump system includes a pump 11 with integral motor 12 that is used to transfer the liquid from a container or vessel (not shown) to a second container or vessel (not shown). A pump controller 15, is a detachable hand-held controller/keypad module coupled to a relay box 14 via a typical coiled electrical communication line 17. The pump controller 15 is electrically coupled to the pump 11 via the relay box 14 and an electrical line 16. The pump controller 15 controls on and off times of the pump 11 according to the user programmed and pre-programmed function thereof. The pump controller 15 has internal digital electronic circuitry as is known in the art for providing the necessary controller functions and to store and execute the present program as described hereinbelow.

The pump 11 is connected via an elbow fitting 18 and a nipple 19 to the inlet side of a nutating disk type flowmeter 20 such that the flowmeter 20 is in fluid communication with the output or outlet of the pump 11. Coupled to the outlet side of the flowmeter 20 is an outlet coupler 21 fluidly connected to a hose or conduit 22. The conduit 22 includes a fitting 26 with a check valve 27 therein coupling the conduit 22 to a hand actuated valve 24. A further conduit 28 is attached to the outlet of the valve 24 which thereafter extends into the secondary tank (not shown) or wherever the fluid is intended to go. The flowmeter 20 is electrically coupled to the pump controller 15 via the relay box 14 and the electrical line 30 for providing information regarding flow via electrical signals to the pump controller 15. Conduit 13 couples the relay box 14 to a typical 12 volt power supply such as a car battery. The relay box 14 supplies power to both the motor 12 via electrical line 16 and the pump controller 15 via electrical line 17. As should be understood, FIG. 1 represents a typical component and hookup diagram in order to practice the present invention. However, other configurations and hookup orientations may likewise be used.

Figure 2:
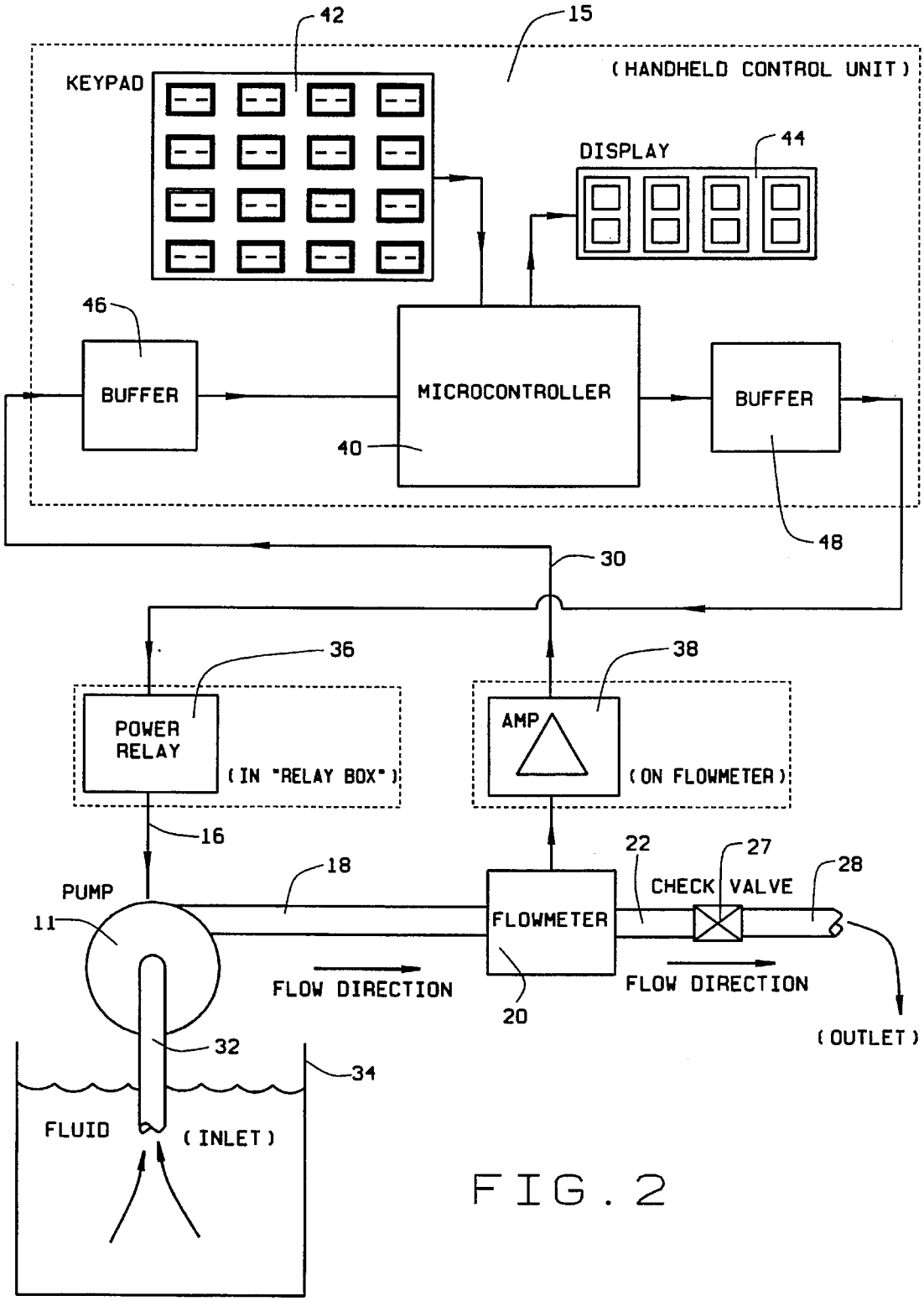
FIG. 2 is a diagram of the depiction of FIG. 1 showing signal flow of the pump controller.

With reference to FIG. 2, the pump 11 is attached to an inlet conduit 32 that is in fluid communication with a fluid filled container or tank 34. The pump 11 is in fluid communication with a nutating disk type flowmeter 20 such as a Great Plains Industries (GPI) nutating disk flowmeter model FM-300H via conduit 18. The flowmeter 20 includes a signal generator or pulse-out mechanism to provide the flow signals as indicated above. The flowmeter 20 output is coupled via conduit 22 to a check valve 27 and outlet conduit 28. The fluid within the tank 34 is thus pumped from the tank 34 into a secondary storage device or tank (not shown) or out to wherever the operator desires. The pump 11 is electrically coupled via electrical line 16 to a power relay 36 with the power relay 36 being controlled or regulated by the pump controller 15. The pump controller 15 is preferably a GPI Model No. PC4b. The GPI PC4b 13 is a multi-feature pump controller that provides total liquid dispensing management and calibration methods. The following is a list of the various features of the GPI PC4b 13 with a brief explanation of each feature.

1.Field Calibration Methods

In addition to the standard fixed volume calibration, the GPI PC4b offers a choice of three calibration methods:

a. "K-Factor-Tweak" in which the unit presents a numerical display of the current calibration K-factor. The user is then allowed to adjust the K-factor as desired.

b. "Dispense/Display" in which the unit presents the most recent total-1 value in the numerical display. The user is then allowed to adjust the value as desired. This method is useful if the user knows the "true" volume of fluid that was dispensed and simply wants to calibrate the meter to read that volume.

c. "Correction Factor" in which the unit presents a numeric multiplication factor on the display. The user is then allowed to adjust the value as above. This is useful if the user knows that the meter reading is consistently "off" by a certain percentage.

2. Independent Totalizer Registers

The unit's totalizer registers "belong" to a particular calibration curve. The totalizer that is displayed at any particular time is the one "belonging" to the currently selected calibration curve. The GPI PC4b currently has the ability to have three (3) calibration curves with independent totalizer registers.

3. Security Code Entry

The GPI PC4b includes a provision for requiring entry of a four digit code at every power up. Until the correct code is entered, none of the normal functions are available. Thus, an unauthorized user cannot pump any fluid. Two options exist for selection of the code for a particular unit:

a. GPI may select the code such that the user must enter the preselected GPI particular code at power up.

b. GPI may allow the customer to enter his own code. This happens at the unit's very initial power up and not thereafter. Whatever four digit sequence is entered becomes the security code for that particular unit. Provision is made for recalling a forgotten code by simultaneously pressing and holding various keys to display the required code.

This security feature is an independently enabled setting among the configuration options. If it is not enabled, the unit will power up without requiring a security code and allow any operator to access its functions.

4. Automatic Low Fluid Shut-Off

When this feature is enabled (a configuration option), the controller will unilaterally stop the pump if the source fluid runs out.

As the automatic flow fluid shut-off feature is an aspect of the present invention, its operation and implementation is further developed and discussed below. Additionally, below is an option listing for the GPI PC4b:

Referring to FIG. 2, the pump controller 15 receives the input data for its operation via the keypad 42 of the pump controller 15 when such is not a preprogrammed feature. The controller 15 also includes the display 44 that serves to indicate information depending on the features selected. The keypad 42 and display 44 are electrically coupled to and in communication with the microcontroller 40. The features and functions outlined above are implemented through the microcontroller 40 and the keypad 42.

In accordance with an aspect of the present invention, the pump controller 15 includes an automatic low fluid or flow shut-off feature, designated "ALFS." This feature is optional with the GPI PC4b and thus it is enabled or disabled during configuration at the manufacturer. When the ALFS is enabled, the controller 15 will unilaterally stop the pump 11 if the source fluid runs out. The determination of whether the source fluid has run out may be ascertained by sensing various pump parameter values such as pump motor speed, pump current draw, or the like. Additionally, the flow meter 20 parameter values may also be monitored and used to indicate when the source fluid has run out.

In the preferred embodiment, the pump controller 15 is programmed to accept flow meter parameter values to indicate that the source fluid is gone. Once the pump controller 15 determines that the source fluid has run out as described below, the microcontroller 40 via buffer 48 shuts off the pump 11.

Figure 3:
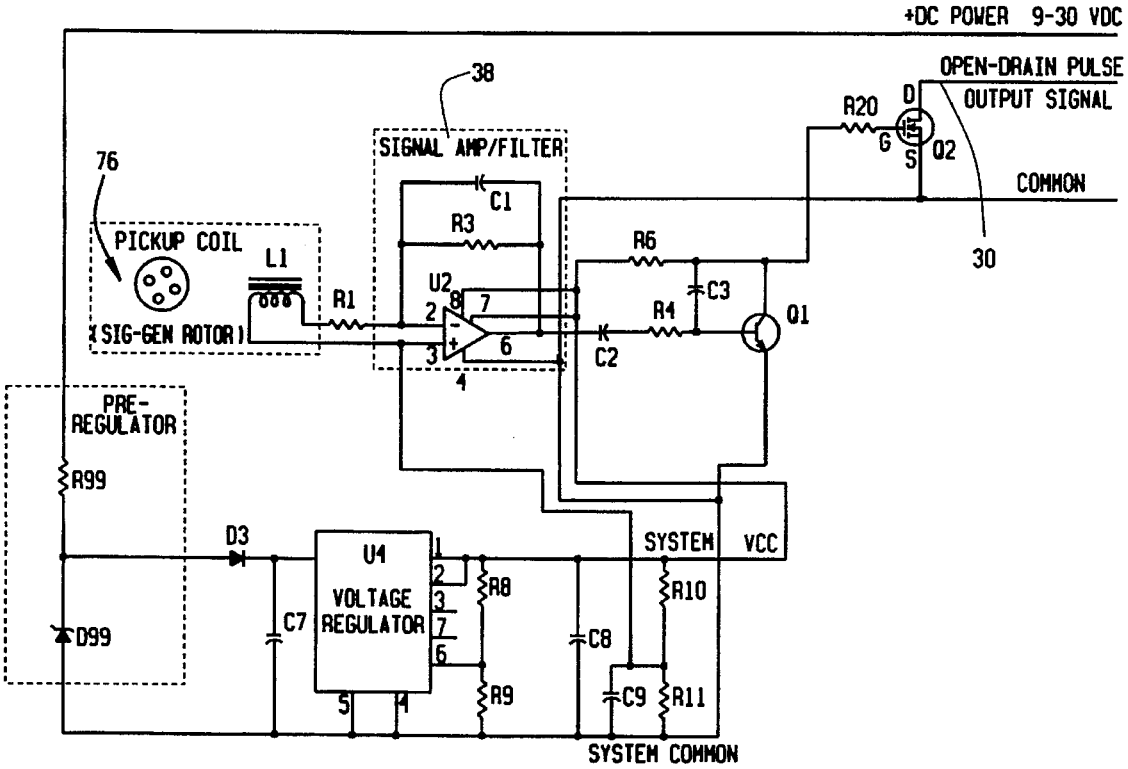
FIG. 3 is an electrical schematic of the flowmeter pulse generator and associated amplifier circuitry.

Referring to FIG. 3, the electrical schematic of the pulse generator of the flow meter 20 is depicted. The pulse generator circuit provides electrical signals to the pump controller 15 according to revolutions of the nutating disk of the flowmeter 20. Thus, as the nutating disk revolves in response to fluid flow, or the like, a series of electrical pulses are generated. Essentially, the pulse-out generator (not shown) within the flow meter 20 includes a pick-up coil L1 and a signal generator rotor 76 associated therewith. As the nutating disk rotates in response to flow through the flowmeter 20, the rotation of the nutating disk moves the signal generator rotor 76 about the pick-up coil L1 to produce electrical pulses. The electrical pulses are amplified by the signal amplifier 38 and fed via line 30 to the microcontroller 40. There are a set number of pulses per revolution of the nutating disk depending on the physical characteristics or make-up of the signal generator rotor. The pulse generator is thus like an encoder. The microcontroller 40 is programmed to count the pulses during a specified or predetermined time period to establish a pulse or flowmeter frequency. The pulse frequency is essentially an instantaneous frequency value that correlates through experimental data to various flow rates. Therefore, when the pulse frequency is known, the flow rate is also known. The number of pulses used to determine the pulse frequency and, thus the flow rate, is totalled and saved at a pre-established interval, such as one second. Thus, every time period of one second, the pulse frequency is established. It should be understood though that the time period or interval for totalling the pulse count may be greater or less than one second depending on the correlation experiment data. Through experiment, it has been found that a one second interval is convenient for pulse totalling.

Thus, the controller 15 receives via electrical lines 30 and 17 a stream of pulses from the flowmeter 20 in response to fluid flowing through the flowmeter. In accordance with the present invention, the microcontroller 40 and circuitry of the pump controller 15 also calculates and stores an average pulse frequency taken over a predetermined time interval or period. Presently, this interval is four seconds. However, as with the pulse count interval, the average pulse frequency time period or interval may be greater or less than four seconds.

The decision of the pump controller 15 to stop the pump is based on the ingestion of air from the source tank. When the container or tank is devoid of liquid, the pump will begin to pump air through the conduits or lines. As air begins to flow through the pumping system there is produced an unambiguous change in the pulse frequency. The controller 15 is programmed to recognize such change and thus checks or compares the one second pulse frequency against the previous average pulse frequency. If there is a change between the pulse frequency and the average pulse frequency, the amount or percentage of change is stored and compared to a pre-selected or predetermined percentage change. If the actual change is equal to or greater than the predetermined percentage change, the controller 15 shuts off the pump 11. Most likely, the change will be a percentage drop in pulse frequency indicating that fluid was being pumped and now is being mixed with air. Thus, in the preferred embodiment, the controller checks once per second whether or not the one second pulse frequency is down by a specified percentage over the average pulse frequency taken over the previous four seconds. Presently, the actual percentage change is a configurable option within the pump controller 15. The manufacturer configures the percentage change by selecting values such as 3%, 6%, 12%, 25%, 33%, or 50%. If the pump is running and the percentage change in the flow rate is equal to or greater than the selected percentage, the controller 15 will stop the pump 11 regardless of whether the pump controller 15 is in an automatic or manual mode. As noted above, the ALFS can be enabled or disabled during a configuration setup of the pump controller by the manufacturer. If enabled, it can be disabled by the user.

Figure 4:
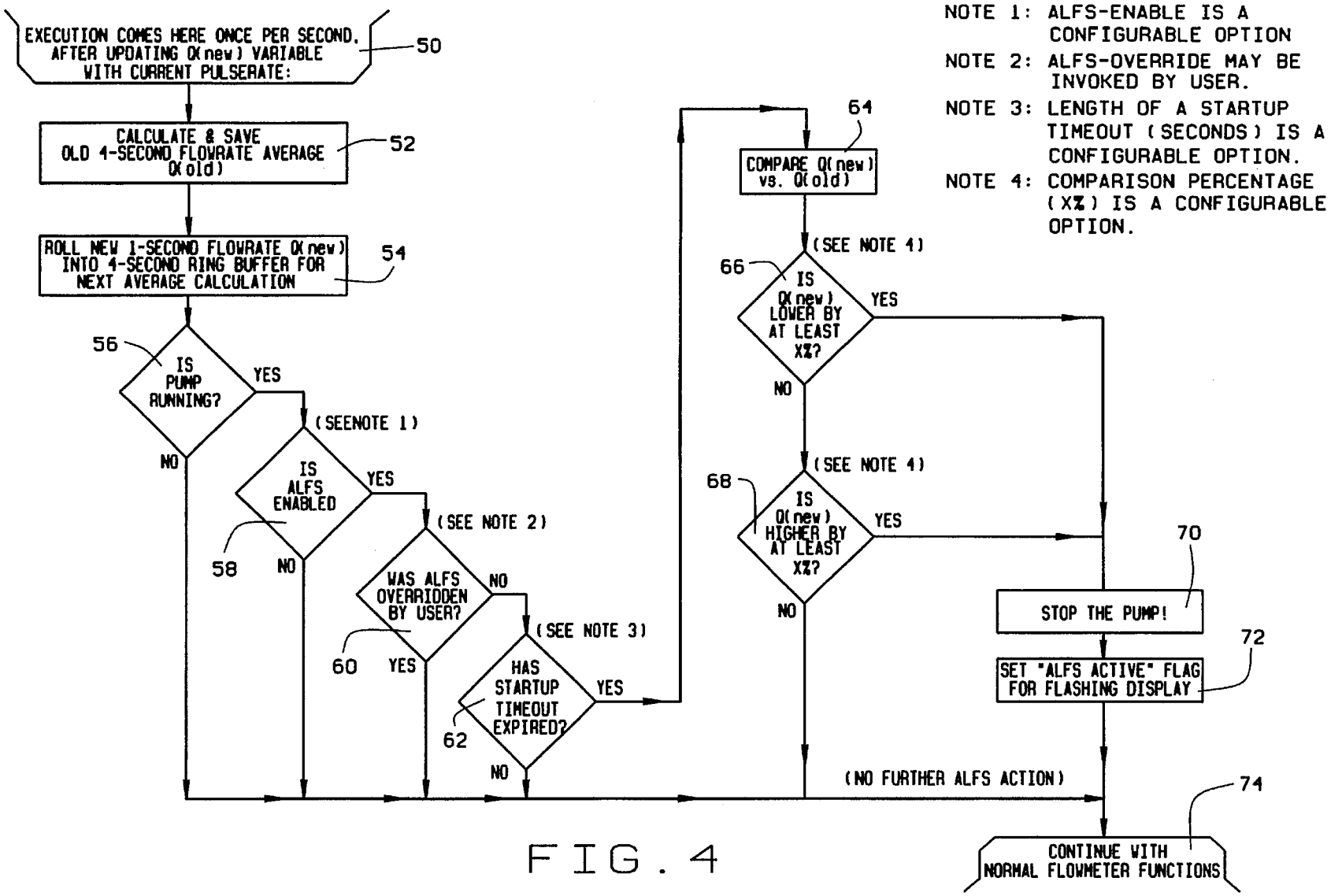
FIG. 4 is a program flow diagram of the present automatic low fluid shut-off method as implemented by the pump controller.

Referring to FIG. 4, the automatic low fluid shut-off (ALFS) flow diagram, as programmed into and implemented by the controller 15, is depicted. Initially, before the transference of any liquid from the container or tank to which the pump 11 is associated, the controller 15 waits a predetermined time period for the pump to commence and run in order to clear any air previously in the conduit or piping before initiating the automatic low fluid shut-off procedure. This is the initial start-up pump time interval. Once the initial startup pump time interval has elapsed, the program checks once per second, 50, after updating the pulse frequency, represented by Q(new) with the current one second pulse rate or frequency. Afterwards, the program calculates and saves an old four second flow rate average, 52. The new one second flow rate or pulse frequency is then rolled into the four second buffer for the next average calculation, 54.

After obtaining these values, the program goes through a series of yes/no inquiries. The first query is whether the pump is running, 56. If no, then no further action is required and the program continues with normal flowmeter function, 74. However, if the pump is running, then the program checks to see if the automatic low fluid shut-off is enabled, 58. If no, then no further action is taken and the normal flowmeter functions, 74 are continued. If the automatic low flow shut-off is enabled, then the program checks to see whether or not the automatic low fluid shut-off has been overridden by the user, 60. If so, then no further action is taken and normal flowmeter functions are continued, 74. If the automatic low flow shut-off has not been overridden by the user, the program checks to see whether the startup or initial pump time out period has expired. If not, the program continues, 74. If the initial pump time period has expired, the program then compares the current one second pulse frequency to the four second average pulse frequency, 64. If the current pulse frequency is lower than the calculated average pulse frequency by at least the selected frequency percentage change, 66, then the controller stops the pump, 70 and the automatic low fluid shut-off active flag for flashing the display, 72, is executed. However, if the one second pulse frequency is not down by the specified percentage relative to the average pulse frequency, then the program checks to see whether the one second pulse frequency is higher by at least the selected percentage over the average pulse frequency to either stop pump, 70, or continue with the flowmeter function, 74, and re-execution, 50, of the entire process. Note, however, that the comparison percentage, whether it be higher or lower, is a configurable option. In this manner, the pump controller 15 stops the pump 11 once fluid is gone from the container 34.

What is claimed is:

1. In a continuous flow pumping system having a pump in fluid communication with a tank of liquid and adapted to transfer the liquid out of the tank, and a pump controller in communication with the pump, a method of automatically stopping the pump when the tank is empty comprising the steps of:

sampling, by the pump controller, of a pump parameter value after an initial pump start-up time interval;

calculating whether there is any percentage change in said pump parameter value once every predetermined sampling time interval relative to an average of pump parameter values taken over a predetermined average time interval;

comparing said percentage change of said pump parameter value to a predetermined pump parameter value percentage change; and stopping the pump when said percentage change of said pump parameter value is greater than said predetermined pump parameter value percentage change.

2. The method of claim 1, wherein said pump parameter value is pump motor speed.

3. The method of claim 1, wherein said pump parameter value is pump motor current draw.

4. The method of claim 1, wherein said pump parameter value is electric pulse frequency generated by a pulse generator within the pump.

5. The method of claim 1, wherein said pump parameter value is instantaneous line pressure.

6. The method of claim 1, wherein said predetermined sampling time interval is one second, and said predetermined average time interval is four seconds.

7. The method of claim 1, wherein said predetermined pump parameter percentage change is greater than 6%.

8. In a continuous flow pumping system having a pump in fluid communication with a container of liquid and adapted to transfer the liquid out of the container, a flowmeter downstream of the pump, and a pump controller in communication with the pump and the flowmeter, a method of automatically stopping the pump when the container of liquid is empty, the method comprising:

monitoring a flow rate of liquid through the flowmeter after an initial predetermined pump start-up time period;

calculating any percentage change in flow rate over a previous average flow rate;

comparing said percentage change in flow rate to a predetermined flow rate percentage change; and stopping the pump when said percentage change in flow rate is greater than said predetermined flow rate percentage change.

9. The method of claim 8, wherein said monitoring step includes the pump controller counting electrical pulses generated by the flowmeter over a predetermined time interval to establish a flowmeter pulse frequency value correlating to the flow rate of liquid therethrough, and said previous average flow rate in said calculating step is determined by averaging a predetermined number of said pulse frequency values.

10. The method of claim 9, wherein said predetermined time interval is one second, and said predetermined number of said pulse frequency values is four.

11. The method of claim 8, wherein said predetermined flow rate percentage change is greater than 6%.

12. The method of claim 9, wherein the flowmeter is a nutating disk flowmeter that includes a pulse generator, the pump controller including a programmed microcontroller that receives the electrical pulses and performs all calculations.

13. The method of claim 12, wherein said programmed microcontroller includes an enable/disable mode for automatically stopping the pump.

14. A method of automatically shutting off a continuous flow type pump in a continuous flow pumping system having the pump in fluid communication with a container of liquid when the container of liquid is empty, the pumping system further including a nutating disk type flowmeter with a pulse generator in fluid communication with and downstream of the pump, and a programmable pump controller in electrical communication with the flowmeter and the pump, the method comprising the steps of:

waiting a minimum pump flow time upon pump startup;

counting the electrical pulses from the flowmeter during a predetermined time interval to determine a pulse frequency;

calculating an average pulse frequency over a predetermined number of said predetermined time intervals;

calculating a percentage change in pulse frequency relative to said average pulse frequency;

comparing said percentage change in pulse frequency to a predetermined percentage change value; and stopping the pump when said percentage change in pulse frequency is greater than said predetermined percentage change value.

15. The method of claim 14, wherein said predetermined time interval is one second, and said predetermined number of said predetermined time intervals is four.

16. The method of claim 14, wherein said predetermined percentage change value is greater than 6%.

17. The method of claim 14, wherein said minimum pump flow time is greater than four seconds.

18. An apparatus for automatically shutting off a pump in a continuous flow pumping system having the pump in fluid communication with a container of liquid, a flowmeter in fluid communication with and downstream of the pump, and a programmable pump controller in communication with the pump and the flowmeter, the apparatus characterized by the flowmeter having a pulse generator providing electrical pulses, the frequency of which correlates to a flow rate of liquid therethrough, the pump controller including a microcontroller configurable to be enabled into an automatic low fluid shutoff mode wherein the frequency of electrical pulses from the flowmeter is monitored and a percentage change in frequency is calculated at a predetermined time interval to an average frequency calculated relative to a predetermined number of predetermined time intervals and if the percentage change in frequency is greater than a selectable percentage change, the pump controller shuts off the pump.

19. The apparatus of claim 18, wherein the flowmeter is a nutating disk flowmeter and said selectable percentage change is one of a value of 3%, 6%, 12%, 25%, 33%, and 50%.

20. The apparatus of claim 18, wherein said predetermined time interval is one second and said predetermined number of predetermined time intervals is four.

* * * * *